US006514294B1

(12) United States Patent
Murphy

(10) Patent No.: US 6,514,294 B1
(45) Date of Patent: Feb. 4, 2003

(54) DRY CLEANING SYSTEM AND PROCESS FOR PRODUCING SOFTER FABRICS

(75) Inventor: Dennis Stephen Murphy, Wyckoff, NJ (US)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 231 days.

(21) Appl. No.: 09/716,072

(22) Filed: Nov. 17, 2000

(51) Int. Cl.[7] ..... D06F 43/00
(52) U.S. Cl. ..... 8/142; 510/466
(58) Field of Search ..... 8/142; 510/466

(56) References Cited

U.S. PATENT DOCUMENTS

| | | | |
|---|---|---|---|
| 3,859,225 A | | 1/1975 | McKnight et al. |
| 5,683,977 A | | 11/1997 | Jureller et al. |
| 5,888,250 A | | 3/1999 | Hayday et al. |
| 5,942,007 A | | 8/1999 | Berndt et al. |
| 6,131,421 A | | 10/2000 | Jureller et al. |
| 6,309,425 B1 | * | 10/2001 | Murphy |

FOREIGN PATENT DOCUMENTS

| | | |
|---|---|---|
| GB | 2014603 | 8/1979 |
| WO | 99/10587 | 3/1999 |
| WO | 00/42249 | 7/2000 |

OTHER PUBLICATIONS

European Search Report Application No. EP 01 20 4180 dated Feb. 26, 2002.

Derwent Publication—XP–002060633 & JP 61 152800 A (Nikka Kagaku Kogyo).

Derwent Publication—XP–002191350 & JP 11 029798 A (Nikka Kagaku KK).

Patent Abstract of Japan, vol. 017, No. 589 (C–1124), & JP 05 171566 A (Nikka Chem. Co. Ltd).

* cited by examiner

*Primary Examiner*—Gregory E. Webb
(74) *Attorney, Agent, or Firm*—Ronald A. Koatz

(57) ABSTRACT

A dry cleaning system and process for improving the characteristics of fabrics is disclosed. The system and process utilize an additive having a silicon atom, and the additive does not enhance the cleaning process but does impart a lubricious soft hand on the fabrics after cleaning.

10 Claims, No Drawings

DRY CLEANING SYSTEM AND PROCESS FOR PRODUCING SOFTER FABRICS

FIELD OF THE INVENTION

This invention is directed to a novel dry cleaning process. More particularly, the invention is directed to a process for dry cleaning substrates in an environmentally friendly solvent whereby an additive is employed to soften and/or reduce wrinkles in the substrates being cleaned.

BACKGROUND OF THE INVENTION

In many cleaning applications, it is desirable to remove contaminants (e.g., stains) from substrates, like metal, ceramic, polymeric, composite, glass and textile comprising substrates. Particularly, it is highly desirable to remove contaminants from fabrics, like clothing, whereby such contaminants include dirt, salts, food stains, oils, greases and the like.

Typically, dry cleaning systems use organic solvents, like chlorofluorcarbons, perchloroethylene, and branched hydrocarbons to remove contaminants from substrates. In response to environmental concerns, however, other dry cleaning systems have been developed that use biodegradable hydrocarbons, silicone comprising solvents, as well as inorganic solvents like densified carbon dioxide.

The cleaning systems that employ environmentally friendly solvents generally employ a cleaning surfactant and a polar solvent so that a reverse-micelle may be formed to trap the contaminant targeted for removal.

When dry cleaning in the manner described above, it is not uncommon for the resulting cleaned substrate to appear wrinkled and/or not feel soft to the touch of the hand.

Since consumers desire the feel of soft clothing that is wrinkle free, and care to preserve the environment, it is of increasing interest to develop a dry cleaning method that is environmentally friendly and results in substrates that are, after cleaning, soft, have reduced wrinkle formation, or both. This invention, therefore, is directed to a dry cleaning process for dry cleaning substrates in an environmentally friendly solvent whereby an additive is employed to improve the characteristics of in the substrates being cleaned.

BACKGROUND REFERENCES

Efforts have been disclosed for dry cleaning garments. In U.S. Pat. No. 5,683,977, a dry cleaning system using densified carbon dioxide and a surfactant adjunct is disclosed.

Still other efforts have been disclosed for dry cleaning cloths. In U.S. Pat. No. 6,131,421, a dry cleaning system with a polysiloxane surfactant is disclosed.

None of the references above disclose a method for dry cleaning in a friendly environment while at the same time reducing, for example, wrinkle formation.

SUMMARY OF THE INVENTION

In a first aspect, the present invention is directed to a method for dry cleaning substrates comprising, in no particular order, the steps of:

contacting a substrate with a solvent selected from the group consisting of a solvent which is a gas at standard temperature and pressure, a biodegradable functionalized hydrocarbon and a silicon comprising solvent; and contacting the substrate with an additive, the additive comprising a first portion which is solvent phobic and a second portion which is solvent philic; and allowing the second portion to impart a lubricious soft hand on the substrate, or to lubricate fiber surfaces of the substrate to reduce wrinkle formation, or both.

In a second aspect, this invention is directed to a method for reducing at least one negative clothing feature selected from the group consisting of pill formation, color loss and shape distortion, comprising, in no particular order, the steps of:

contacting a substrate with a solvent selected from the group consisting of a solvent which is a gas at standard temperature and pressure, a biodegradable functionalized hydrocarbon and a silicon comprising solvent;

contacting the substrate with an additive, the additive comprising a first portion which is solvent phobic and a second portion which is solvent philic; and allowing the second portion to coat fibers on the substrate in order to reduce pill formation, reduce color loss and/or reduce shape distortion.

In a third aspect, the present invention is directed to a dry cleaning system comprising an additive for improving substrate characteristics.

Lubricious soft hand is defined to mean a perceived softness improvement by a panel of evaluators assessing the softness of cleaned fabrics.

DETAILED DESCRIPTION OF THE PREFERRED EMBODIMENTS

There generally is no limitation with respect to the solvent (i.e., fluid) employed in this invention other than that the solvent is a gas at standard temperature and pressure, a biodegradable hydrocarbon or a silicon comprising solvent, and capable of being a continuous phase in a dry cleaning application. Illustrative examples of the types of solvents which may be employed in this invention include a $C_2$–$C_4$ substituted or unsubstituted alkane, carbon dioxide, silicone oil, and an azeotropic solvent.

Regarding the solvent which is.a gas at standard temperature and pressure, such a solvent may be, within the dry cleaning process, a gas, liquid or supercritical fluid depending upon how densified the solvent is (how much pressure is applied at a given temperature) in the domestic or commercial cleaning application the solvent is used in. Propane and carbon dioxide tend to be the preferred solvents.

As to the silicon comprising solvent which may be used in this invention, such a solvent is typically a commercially available cyclic-siloxane based solvent made available from GreenEarth Cleaning, LLC. Such a solvent is generally one which has a flash point over about 65° C., with octamethylcyclotetrasiloxane and decomethyl-cyclopentasiloxane being most preferred. A more detailed description of such conventional siloxane comprising solvents may be found in U.S. Pat. No. 5,942,007, the disclosure of which is incorporated herein by reference.

The biodegradable functionalized hydrocarbon that may be used in this invention includes those generally classified as an azeotropic solvent. Such an azeotropic solvent often comprises alkylene glycol alkyl ethers, like propylene glycol tertiary-butyl ether, and is described in U.S. Pat. No. 5,888,250, the disclosure of which is incorporated herein by reference. Moreover, as used herein, biodegradable functionalized hydrocarbon is defined to mean a biodegradable hydrocarbon comprising at least one member selected from the group consisting of an aldehyde, ketone, alcohol, alkoxy, ester, ether, amine, amide and sulfur comprising group.

When the solvent employed is a gas at standard temperature and pressure, like propane or carbon dioxide, the machine which is employed for cleaning is well known in the art. Such a machine typically comprises a gas supply, cleaning tank and condenser. The machine may further comprise a means for agitation; particularly, when the contaminated substrate targeted for removal is a fabric. The means for agitation may be, for example, a mechanical device like a mechanical tumbler, or a gas-jet agitator. The art recognized machines which may be used in this invention (e.g., when solvent which is a gas at STP is used) may be found in U.S. Pat. Nos. 5,943,721, 5,925,192, 5,904,737, 5,412,958, 5,267,455 and 4,012,194, the disclosures of which are incorporated herein by reference.

When the solvent employed in this invention is a biodegradable functionalized hydrocarbon or a silicon comprising solvent, the machine employed may be the same or substantially the same as any of the commonly used machines used for dry cleaning with perchloroethylene. Such machines typically comprise a solvent tank or feed, a cleaning tank, distillation tanks, a filter and solvent exit. These commonly used machines are described, for example, in U.S. Pat. No. 4,712,392, the disclosure of which is incorporated herein by reference.

Once the substrate being cleaned is inserted in or subjected to the machine employed for cleaning, the ordinary cleaning cycle is run (typically between about three (3) minutes to about one (1) hour) and the substrate is cleaned. Thus, to demonstrate cleaning, it is not required to add anything to the cleaning machine other than the substrate comprising the contaminant targeted for removal (having the stain removal composition applied thereon) and the solvent that is a gas at standard temperature and pressure, a biodegradable functionalized hydrocarbon or a silicon comprising solvent.

In a preferred embodiment, however, a polar solvent, such as water, is employed along with a continuous phase surfactant (i.e., surfactant which is substantially soluble in the solvent) that is capable of forming a reverse micelle in a continuous phase formed by the solvent. When a polar solvent and a continuous phase surfactant are employed, the amount of polar solvent used is typically about 0.5 to about 8 times, and preferably, from about 1 to about 5 times; most preferably, from about 1.5 to about 2.5 times the amount of continuous phase surfactant employed in the resulting dry-cleaning composition.

The amount of continuous phase surfactant used in the dry-cleaning composition is typically between about 0.01 to about 2.0 wt. %; and preferably, from about 0.02 to about 1.0 wt. %; most preferably, from about 0.03 to about 0.8 wt. % continuous phase surfactant, based on total volume of the dry-cleaning composition, including all ranges subsumed therein.

When the solvent employed is a gas at standard temperature and pressure or a silicon comprising surfactant, the continuous phase surfactant is typically any surfactant that comprises a group having an affinity for the polar solvent and a group having an affinity for the solvent. Such a continuous phase surfactant may comprise sodium bis(2-ethylhexyl) sulfosuccinate [Aerosol OT or AOT], made commercially available from Aldrich. When AOT is employed, it is preferred that the solvent is a $C_2$–$C_4$ substituted or unsubstituted alkane, preferably propane. Other continuous phase surfactants which may be used include didodecyl dimethyl ammonium bromide, polyoxyethylene ethers (e.g., Brij 30, Brij 52) and lecithin. Such continuous phase surfactants are described in U.S. Pat. Nos. 5,158,704 and 5,266,205, the disclosures of which are incorporated herein by reference.

Additional continuous phase surfactants which may be used in this invention include end-functionalized polysiloxanes. Such end-functionalized polysiloxanes are represented in general, by the formula $B_1$-A-$B_2$ wherein $B_1$ and $B_2$ are each independently an end-functional group and A is a polysiloxane such as polydimethysiloxane (having an average weight molecular weight of about 75 to about 400,000.

The end-functionalized polysiloxanes typically are represented by the formula:

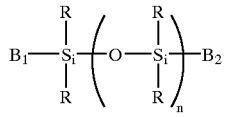

wherein n is an integer from about 1 to about 10,000, preferably from about 1 to about 100.

At least one and preferably, both of $B_1$ and $B_2$ are solvent phobic groups such as lipophilic or hydrophilic (e.g., anionic, cationic) groups, but are not $CO_2$-philic groups. Each R is independently an alkyl, aryl or haloalkyl, with perfluoroalkyl, $C_1$–$C_4$ alkyls, phenyl and trifluoropropyl being the preferred R groups.

Regarding $B_1$ and $B_2$, such end-functional groups may be derived from silicones with reactive groups that yield end-functional materials upon contact with a substrate. Illustrative examples of such reactive groups include vinyl, hydride, silanol, alkozy/polymeric alkoxide, amine, epoxy, carbinol, methacrylate/acrylate, mercapto, acetoxy/chlorine/dimethylamine moieties.

A more detailed description of the types of end-functionalized polysiloxanes which may be used in this invention may be found in WO 99/10587, the disclosure of which is incorporated herein by reference.

Other continuous phase surfactants which may be employed in this invention include those generally classified as acetylenic alcohols or diols as represented by the formulae below, respectively:

(alcohol)

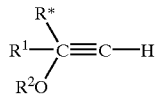

(diol)

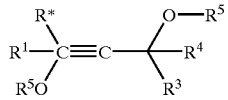

wherein R*, $R^1$, $R^3$ and $R^4$ are each independently hydrogen atoms or linear or branched alkyl groups comprised of 1 to 38 carbons, and $R^2$ and $R^5$ are each hydrogen atoms or hydroxyl terminated polyalkylene oxide chains derived from 1 to 30 alkylene oxide monomer units of the following structure:

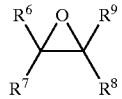

wherein $R^6$, $R^7$, $R^8$ and $R^9$ are each independently hydrogen atoms, linear or branched alkyl groups having about 1 to about 5 carbons, or phenyl.

Still other continuous phase surfactants which may been employed in this invention include alkoxylated fatty alcohols having, for example, ethoxy or ethoxy and propoxy in a ratio of about 2:1 and an aliphatic chain comprising from about 8 to about 15 carbon atoms. These types of surfactants are most often preferred when the solvent employed is a biodegradable functionalized hydrocarbon.

The most preferred and the superior continuous phase surfactants which may be used in this invention include those having the formula:

$$MD_xD^*_yM$$

wherein M is a tialkylsiloxyl end group, $D_x$ is a dialkylsiloxyl backbone which is solvent-philic and $D^*_y$ is one or more alkylsiloxyl groups which are substituted with a solvent-phobic group wherein each solvent phobic group is independently defined by the formula:

$$(CH_2)_a(C_6H_4)_b(A)_d—[(L)_e—(A')_f—]_n—(L')_gZ(G)_h$$

wherein a is 1–30, b is 0 or 1, $C_6H_4$ is unsubstituted or substituted with a $C_{1-10}$ alkyl or alkenyl, and A and A' are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof, L and L' are each independently a $C_{1-30}$ straight chained or branched alkyl or alkenyl or an aryl which is unsubstituted or substituted, E is 0–3, F is 0 or 1, N is 0–10, G is 0–3, O is 0–5, Z is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium, G is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate, or tosylate, and h is 0–3.

Such surfactants are described in U.S. Pat. Nos. 5,676,705, 5,683,977, 5,683,473, commonly assigned to Lever Brothers Company, a Division of Conopco, Inc., the disclosures of which are incorporated herein by reference.

When performing the actual cleaning of the contaminated substrate, it is most preferred in this invention for the substrate to be a fabric such as clothing and the solvent to be densified carbon dioxide wherein the continuous phase surfactant is polyorganosiloxane derived. Typically, when the cleaning process takes place, the carbon dioxide is maintained at a temperature from about 0.0 to about 50° C., and preferably, from about 5.0 to about 30° C., and most preferably, from about 8.0° C. to about 25.0° C., including all ranges subsumed therein. Moreover, when carbon dioxide is used, it is typically maintained at a pressure from about 150 to about 10,000 psi, and preferably, from about 300 to about 2,500 psi, and most preferably, from about 500 to about 1,300 psi, including all ranges subsumed therein.

As to the additive which may be used in this invention, such an additive is limited only to the extent that it can coat fibers of the substrates it is contacted with and is not substantially soluble in the solvent employed. Often, from about 5% to about 90%, and preferably, from about 5% to about 75%, and most preferably, from about 7% to about 25% of the additive is soluble in the solvent when the additive has a siloxane or siloxane derived backbone. Soluble in the solvent is defined to mean that the additive is soluble only to a certain degree within a predetermined use level of additive to solvent. For example, when the dry cleaning method that softens substrates or the method for reducing negative clothing features is conducted, from about 10%, to about 90% of the additive will be soluble in the amount (use level) of solvent used. Typically, from about 0.01% to about 3.5% by weight of additive is used based on total volume of solvent.

The additive which may be used in this invention is preferably a silicon comprising compound, oligomer or polymer comprising at least one positive charge. Most preferably, however, the additive which may be used in this invention is a silicon comprising compound, oligomer or polymer which is, overall, positively charged and having a weight average molecular weight (Mw) from about 100 to about 500,000.

The additive comprising a silicon which may be used in this invention often is represented by the formulae:

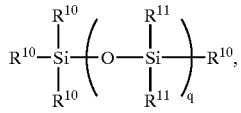

or

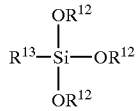

wherein each $R^{10}$ and $R^{11}$, is independently a hydrogen, $C_{1-10}$ alkyl, halogen, nitride group, nitro group, sulfonate group, ester group, hydroxy, carboxy, alkoxy, aryl, or a moiety with a positive charge, with the proviso that at: least one $R^{10}$ or $R^{11}$ is a moiety with a positive charge, and q is an integer from about 1 to about 15,000. Each $R^{12}$ is independently a hydrogen or $C_{1-10}$ alkyl and $R^{13}$ is a moiety with a positive charge. In this invention it is preferred that no more than about 25% by weight (preferably no more than about 15% by weight) of the total weight of additive is moiety with a positive charge when the additive has a siloxane or siloxane derived backbone.

The moiety with the positive charge is limited only to the extent that such a moiety has a greater affinity for the substrate than the solvent. Therefore, it is noted that the portion of the additive having a positive charge is herein defined to mean the first portion which is solvent-phobic, and the portion of the additive that does not comprise a positive charge is defined herein to be the second portion which is solvent-philic.

Regarding the moiety having the positive charge, such a moiety often has a formula represented as:

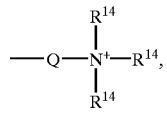

or

-continued

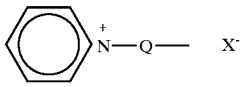

wherein each $R^{14}$ is independently H, a carboxylic acid functionalized group or a $C_{1-20}$ alkyl and $X^-$ is a counter anion selected from the group consisting of $Cl^-$, $F^-$, $Br^-$, $I^-$ or $SO_4^-$ is a divalent bridging radical such as a divalent hydrocarbon, an arylene (e.g., phenylene) or a substituted or unsubstituted divalent group comprising an ether linkage. In the above formula, z is a $C_{1-4}$ alkyl, preferably methyl, and t is an integer from about 1–5.

The additives which may be used in this invention are commercially available from suppliers like Witco, Sherex and Goldschmidt AG. The preferred additives which may be used in this invention are sold under the name ABIL®, like ABIL® Quat 3474 and ABIL® Quat 3270.

A most preferred additive used in this invention is one where q is 80 to 250; both terminal silicon atoms have one moiety ($R^{10}$) with a positive charge and the remaining $R^{10}$ groups and the $R^{11}$ groups are methyl.

For the sake of brevity, it is within the scope of this invention for the silicon comprising additive which is siloxane-based to have a moiety with a positive charge on one terminal silicon atom, both terminal silicon atoms, off a silicon atom within the backbone only, or any other combinations thereof.

The examples which follow are provided to illustrate and facilitate an understanding of the present invention. The examples are not intended to limit the scope of the claims which follow.

EXAMPLE 1

In the experiment, 11"×11" cloths of 50% polyester and 50% cotton were used to test for softening. Five (5) replicates of cloth were used. The test cloths were placed in the cleaning chamber of a $CO_2$ dry cleaning unit as taught in U.S. Pat. No. 5,467,492. The cleaning unit was equipped with hydrodynamic agitation capabilities. To simulate a full load of clothes, nine (9) pounds of cotton ballast sheets (11"×11") were also placed in the cleaning chamber of the dry cleaning unit. The dry cleaning unit employed circulated a total volume of about 490 liters of liquid $CO_2$ in the cleaning loop of the cleaning chamber. There was also a storage tank on the unit from which fresh liquid $CO_2$ was added once the chamber door was closed and sealed. The cleaning cycle lasted for 15 minutes at about 850 psi and 11 degrees Celsius. After the cleaning cycle, the liquid $CO_2$ in the cleaning loop was pumped back into the storage tank, and the chamber door was opened.

Two experiments were run—one with $CO_2$ alone (as the control) and one with 245 g (0.05% weight/volume) of Silwet L-7602 ($CO_2$ soluble polydimethylsiloxane) from Witco Chemical Co. For the Silwet run, the silicone material was added directly to the bottom of the cleaning chamber, below the cotton ballast. Evaluators then did blind side-by-side comparisons of the cloths from each run and were asked to report which cloth felt softer. After the comparisons, 75% of the evaluators reported that the cloth treated with Silwet L-7602 felt softer.

EXAMPLE 2

Example 2 was carried out in a manner similar to the one described in Example 1 except that one wash was carried out with $CO_2$ alone (as the control) and one wash was carried out with 245 g (0.05% weight/volume) of ABIL Quat 3474 from Goldschmidt Chemical Co. in lieu of the soluble polydimethysiloxane as used in Example 1. Evaluators then did blind side-by-side comparisons of the cloths from each run and were asked to report which cloth felt softer. After making comparisons, p100% of the evaluators reported that the cloths treated with ABIL Quat 3474 were softer than the control. The results herein show that the additives described in this invention unexpectedly result in softer cloths after dry cleaning.

What is claimed is:

1. A dry cleaning process comprising, in no particular order, the steps of:

contacting a substrate with a solvent selected from the group consisting of a solvent which is a gas at standard temperature and pressure, a biodegradable functionalized hydrocarbon and a silicon comprising solvent; and contacting the substrate with an additive, the additive comprising a first portion which is solvent phobic and a second portion which is solvent philic;

wherein the additive has the formula:

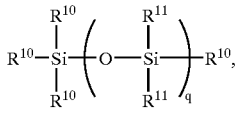

or

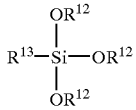

wherein each $R^{10}$ and $R^{11}$, is independently a hydrogen, $C_{1-10}$ alkyl, halogen, nitride group, nitro group, sulfonate group, ester group, hydroxy, carboxy, alkoxy, aryl, or a moiety with a positive charge, with the proviso that at least one $R^{10}$ or $R^{11}$ is a moiety with a positive charge, and q is an integer from about 1 to about 15,000, and each $R^{12}$ is independently a hydrogen or $C_{1-10}$ alkyl and $R^{13}$ is a moiety with a positive charge;

wherein the moiety with a positive charge has the formula:

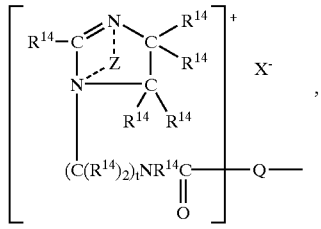

or

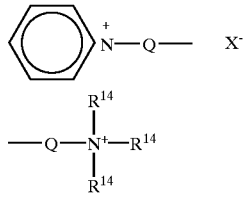

wherein each $R^{14}$ is independently H, a carboxylic acid functionalized group or a $C_{1-20}$ alkyl and $X^-$ is a counter anion selected from the group consisting of $Cl^-$, $Fl^-$, $Br^-$, $I^-$ or $SO_4^-$; and Q is a divalent bridging radical and z is a $C_{1-4}$ alkyl, and t is an integer from about 1–5; and allowing the second portion to impart a lubricious soft hand on the substrate, or to lubricate fiber surfaces of the substrate to reduce wrinkle formation, or both.

2. The dry cleaning process according to claim 1 wherein the solvent is a gas at standard temperature and pressure.

3. The dry cleaning process according to claim 2 wherein the solvent is carbon dioxide.

4. The dry cleaning process according to claim 1 wherein the substrate is fabric.

5. The dry cleaning process according to claim 1 wherein the additive is from about 5.0% to about 90% soluble in the solvent.

6. The dry cleaning process according to claim 1 wherein the additive is siloxane-derived and has no more than about 25% by weight moiety with a positive charge based on total weight of the additive.

7. The dry cleaning process according to claim 1 wherein the dry cleaning process occurs in a dry cleaning machine.

8. The dry cleaning process according to claim 1 wherein the dry cleaning process further comprises the step of adding a continuous phase surfactant that is substantially soluble in the solvent.

9. A method for reducing at least one negative clothing feature selected from the group consisting of pill formation, color loss and shape distortion, comprising, in no particular order, the steps of:

contacting a substrate with a solvent selected from the group consisting of a solvent which is a gas at standard temperature and pressure, a biodegradable functionalized hydrocarbon and a silicon comprising solvent;

contacting the substrate with an additive, the additive comprising a first portion which is solvent phobic and a second portion which is solvent philic;

wherein the additive has the formula:

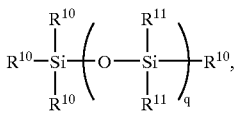

or

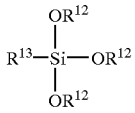

wherein each $R^{10}$ and $R^{11}$, is independently a hydrogen, $C_{1-10}$ alkyl, halogen, nitride group, nitro group, sulfonate group, ester group, hydroxy, carboxy, alkoxy, aryl, or a moiety wit a positive charge, with the proviso that at least one $R^{10}$ or $R^{11}$ is a moiety with a positive charge, and q is an integer from about 1 to about 15,000, and each $R^{12}$ and $R1^3$ is a moiety with a positive charge;

wherein the moiety with a positive charge has the formula:

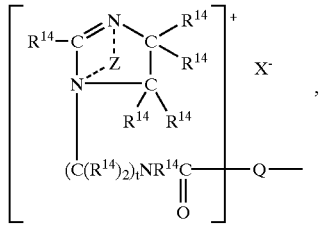

or

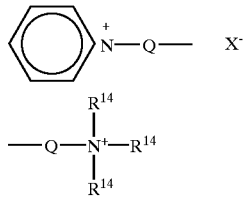

wherein each $R^{14}$ is independently H, a carboxylic acid functionalized group or a $C_{1-20}$ alkyl and $X^-$ is a counter anion selected from the group consisting of $Cl^-$, $Fl^-$, $Br^-$, $I^-$ or $SO_4^-$; and Q is a divalent bridging radical and z is a $C_{1-4}$ alkyl, and t is an integer from about 1–5; and allowing the second portion to coat fibers on the substrate in order to reduce pill formation, reduce color loss and/or reduce shape distortion.

10. A dry cleaning system comprising:

(a) carbon dioxide;

(b) a surfactant which is substantially soluble in carbon dioxide;

(c) a polar solvent;

(d) an additive comprising a first portion which is $CO_2$ phobic and a second portion which is $CO_2$ philic;

wherein the additive has the formula:

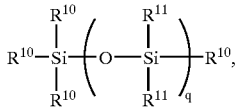

or

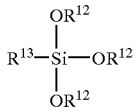

wherein each $R^{10}$ and $R^{11}$, is independently a hydrogen, $C_{1-10}$ alkyl, halogen, nitride group, nitro group, sulfonate group, ester group, hydroxy, carboxy, alkoxy, aryl, or a moiety with a positive charge, with the proviso that at least one $R^{10}$ or $R^{11}$ is a moiety with a positive charge, and q is an integer from about 1 to about 15,000, and each $R^{12}$ is independently a hydrogen or $C_{1-10}$ alkyl and $R^{13}$ is a moiety with a positive charge;

wherein the moiety with a positive charge has the formula:

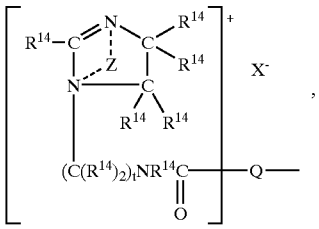
or
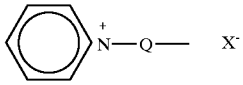
-continued
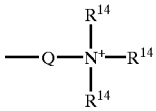
wherein each $R^{14}$ is independently H, a carboxylic acid functionalized group or a $C_{1-20}$ alkyl and $X^-$ is a counter anion selected from the group consisting of $Cl^-$, $Fl^-$, $Br^-$, $I^-$ or $SO_4^-$; and Q is a divalent bridging radical and z is a $C_{1-4}$ alkyl, and t is an integer from about 1–5;
wherein from about 7.0% to about 25% of the additive is soluble in carbon dioxide.
* * * * *